US007427228B1

(12) United States Patent
Kirsch

(10) Patent No.: US 7,427,228 B1
(45) Date of Patent: Sep. 23, 2008

(54) HANDHELD MATERIAL CONDITIONER

(76) Inventor: Cyrus W Kirsch, P.O. Box 383, Penn Run, PA (US) 15765

( * ) Notice: Subject to any disclaimer, the term of this patent is extended or adjusted under 35 U.S.C. 154(b) by 0 days.

(21) Appl. No.: 11/671,144

(22) Filed: Feb. 5, 2007

Related U.S. Application Data

(60) Provisional application No. 60/766,683, filed on Feb. 6, 2006.

(51) Int. Cl.
*B24B 23/03* (2006.01)

(52) U.S. Cl. ..... 451/357; 451/359

(58) Field of Classification Search ..... 451/357, 451/359, 354, 350, 362, 344, 353; 15/49.1
See application file for complete search history.

(56) References Cited

U.S. PATENT DOCUMENTS 2,759,305 A * 8/1956 Helbig ..... 451/356
3,169,262 A * 2/1965 Allen et al. ..... 15/49.1
3,354,488 A * 11/1967 Bilde ..... 15/49.1
4,328,645 A * 5/1982 Sauer ..... 451/359
6,494,772 B1 * 12/2002 Barnes et al. ..... 451/353
7,022,004 B2 * 4/2006 Bohler ..... 451/353
7,140,957 B2 * 11/2006 Thysell et al. ..... 451/350

* cited by examiner

*Primary Examiner*—Hadi Shakeri
(74) *Attorney, Agent, or Firm*—John J. Elnitski, Jr.

(57) ABSTRACT

A handheld material conditioner including at least three orbital head assemblies. The handheld material conditioner including a motor, where the motor is connected to the at least three orbital head assemblies. The handheld material conditioner including a housing to house the motor. The housing having at least one handle and having an on/off device to send power to the motor. The handheld material conditioner including a base to which the at least three orbital head assemblies are attached. The base having a top, bottom and at least one side extending down from the base. The handheld material conditioner including a conditioning pad attached to each of the at least three orbital head assemblies.

7 Claims, 11 Drawing Sheets

10

HANDHELD MATERIAL CONDITIONER

This application claims the benefit of U.S. Provisional Application No. 60/766,683 filed Feb. 6, 2006

BACKGROUND

Conditioning or reconditioning of a material usually requires polishing or sanding of the material. Examples of materials to be polished include materials such as marble and stainless steel. Examples of materials to be sanded include wood of a furniture top or hardwood floors. Hardwood floors are especially difficult to sand in areas along walls, where it is cumbersome to sand with the large commercial sanding machines. It has been found that the many of the handheld sanders available are difficult to control and use by an inexperienced do-it-yourselfer type of operator.

It is an object of the present invention to provide a device for conditioning materials which is easier to operate for the do-it-yourselfer that lacks the operating experience of such devices.

SUMMARY OF THE INVENTION

A handheld material conditioner including at least three orbital head assemblies. The handheld material conditioner including a motor, where the motor is connected to the at least three orbital head assemblies. The handheld material conditioner including a housing to house the motor. The housing having at least one handle and having an on/off device to send power to the motor. The handheld material conditioner including a base to which the at least three orbital head assemblies are attached. The base having a top, bottom and at least one side extending down from the base. The handheld material conditioner including a conditioning pad attached to each of the at least three orbital head assemblies.

DETAILED DESCRIPTION

Figure 1:
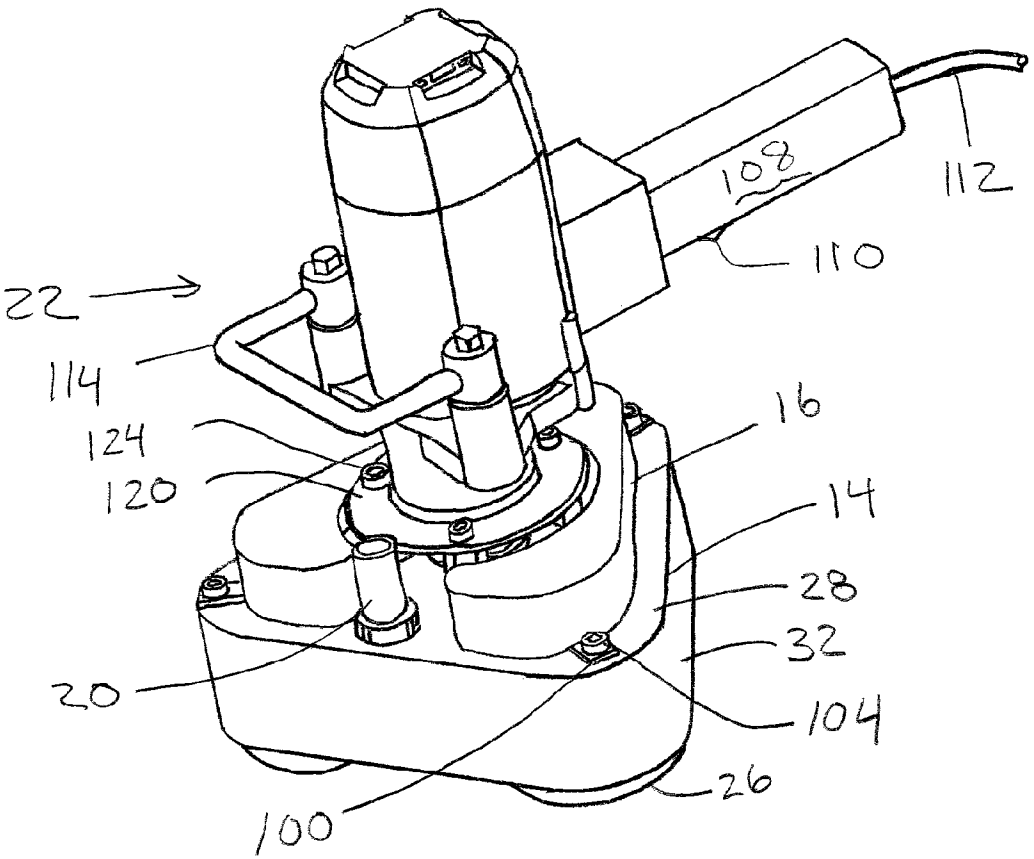
FIG. 1 is a perspective view of a handheld material conditioner according to the present invention.
Figure 2:
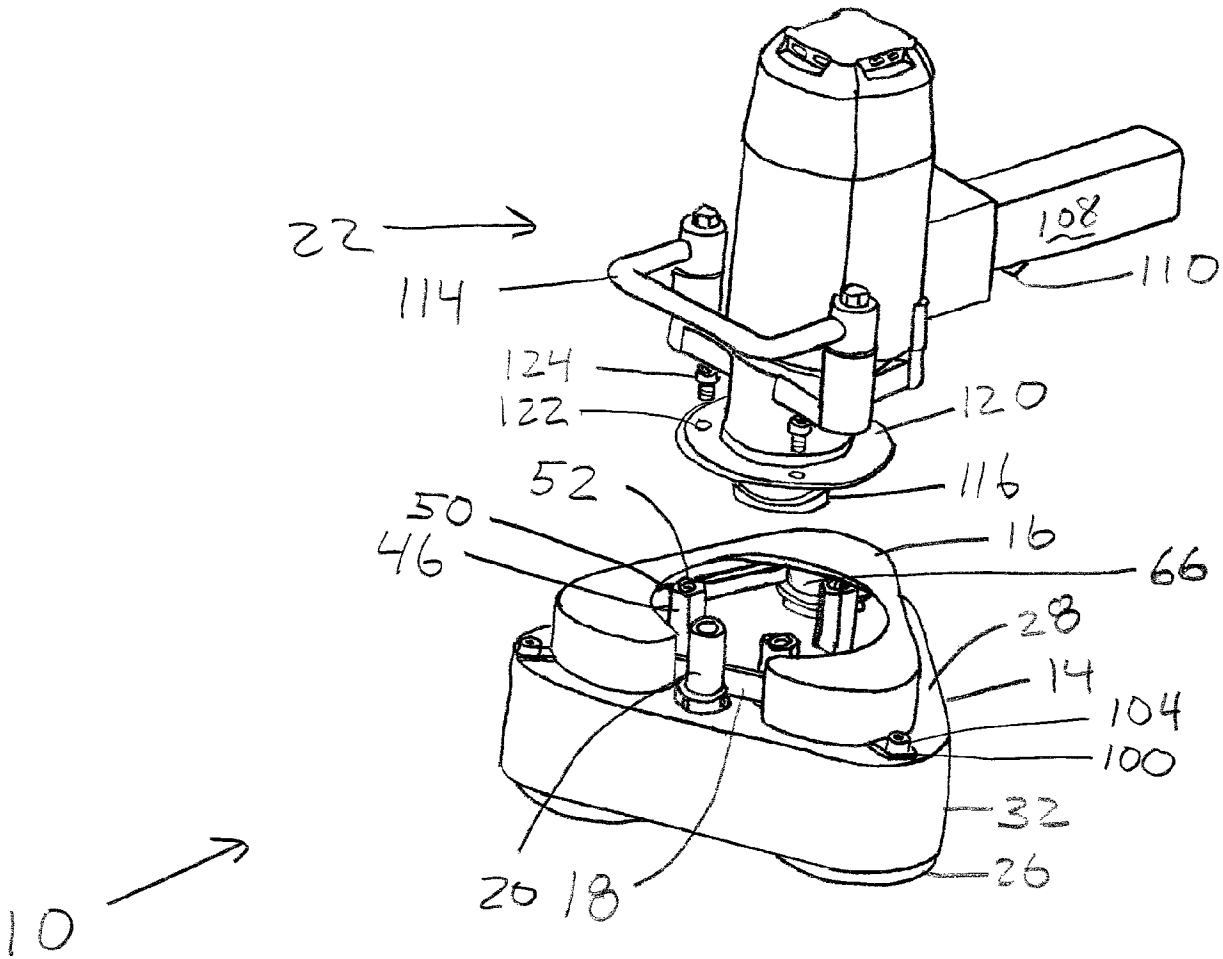
FIG. 2 is a perspective view of a handheld material conditioner according to the present invention.

The present invention is a handheld material conditioner 10. The handheld material conditioner 10 is shown and described as a sander for sanding materials. The handheld material conditioner 10 can be easily converted to do other types of material conditioning, by changing the type of conditioning pad that is employed. The handheld material conditioner 10 improves the ease of use as compared to currently available devices due to a random rotating orbital action and the number of conditioning pads. Thereby, allowing the unsophisticated do-it-yourselfer to use the handheld material conditioner 10. The handheld material conditioner 10 is shown in FIGS. 1-2, and components of the handheld material conditioner 10 are shown in FIGS. 1-11. The handheld material conditioner 10 provides a random rotating orbital sanding action, which greatly improves the ability to control the handheld material conditioner 10 and provides a much nicer job of conditioning the wood material of a floor. The handheld material conditioner 10 includes a base 14, belt cover 16, belt 18, dust collection tube 20, motor assembly 22, and three orbital head assemblies 24 with conditioning pads 26.

Figure 3:
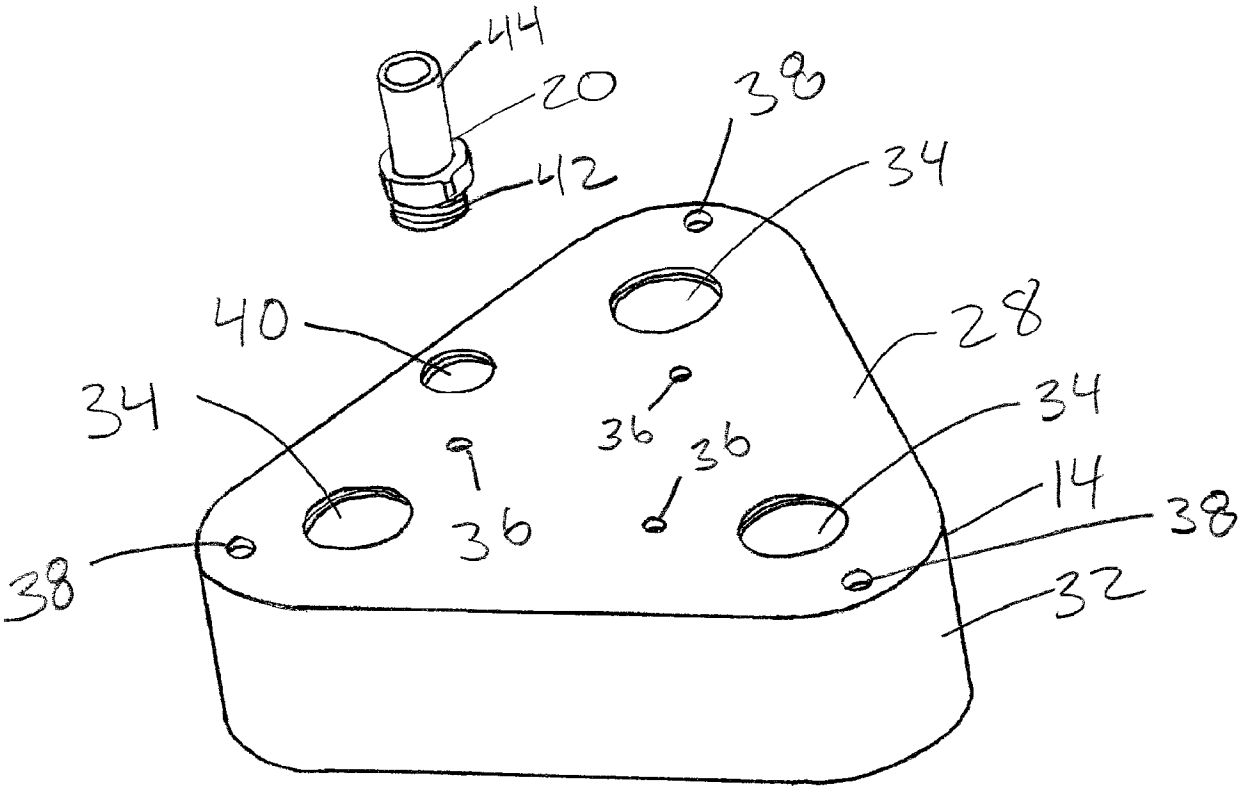
FIG. 3 is a perspective view of a base of a handheld material conditioner according to the present invention.
Figure 4:
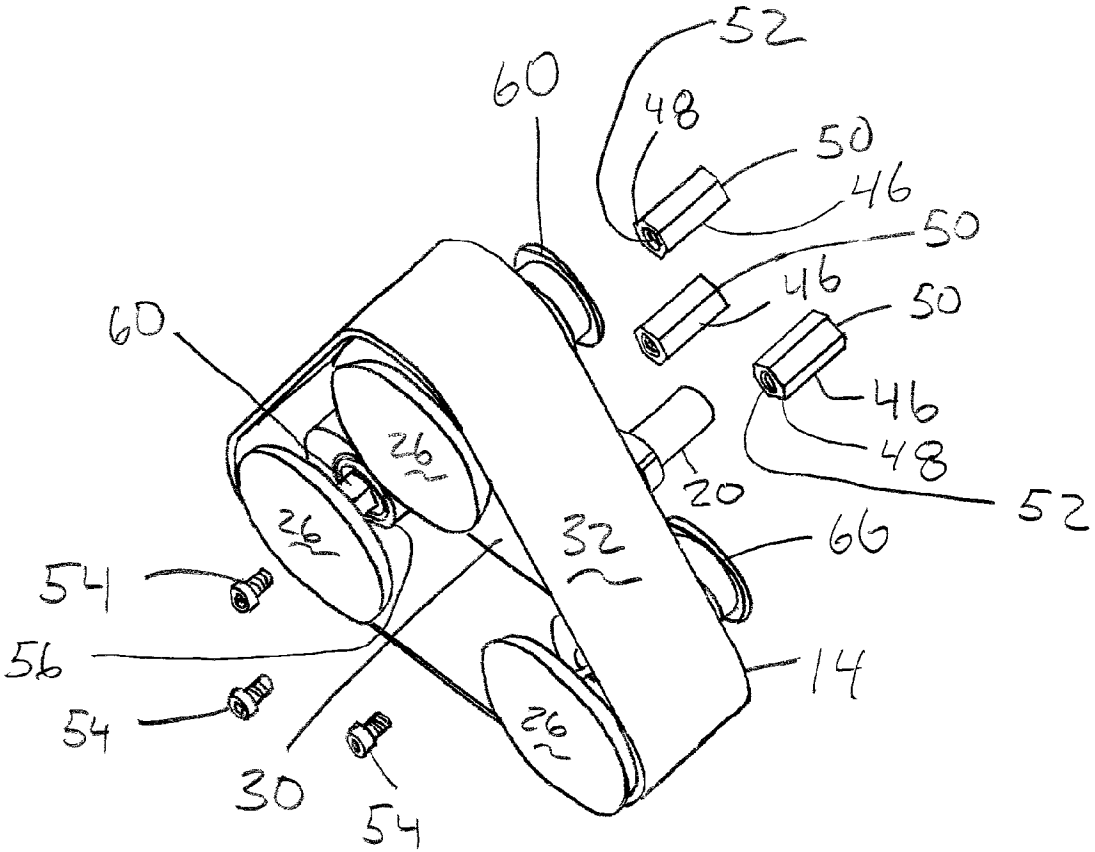
FIG. 4 is a perspective view of a base of a handheld material conditioner according to the present invention.

The base 14 is to which all the other components of the handheld material conditioner 10 are connected. The base 14 includes a top 28, bottom 30 and continuous side 32 extending from the bottom 30 of the base 14. The continuous side 32 acts as shield for safety. The base 14 includes orbital head assembly holes 34, motor spacer holes 36, belt cover holes 38 and a dust collection hole 40. FIG. 3 shows the dust collection tube 20 with a threaded base end 42 and a vacuum end 44. The base end 42 treads into the dust collection hole 40 to allow mounting of the dust collection tube 20 to the base 14. The vacuum end 44 is for attachment of a vacuum to the dust collection tube 20 for the collection of dust during use of the handheld material conditioner 10. The motor spacer holes 36 allow for the mounting of motor spacers 46, as shown in FIGS. 2, 4, and 8-9. The motor spacers 46 include a base end 48 and a motor end 50. Both the base end 48 and motor end 50 include a threaded opening 52. The threaded opening 52 of the base end 48 of each motor spacer 46 is placed over one of the motor spacer holes 36 on the top 28 of the base 14. A bolt 54 is inserted into the motor spacer hole 36 at the bottom 30 of the base 14 and threaded into the threaded opening 52 of the base end 48 of each motor spacer 46 to secure the motor spacer 46 to the base 14.

Figure 5:
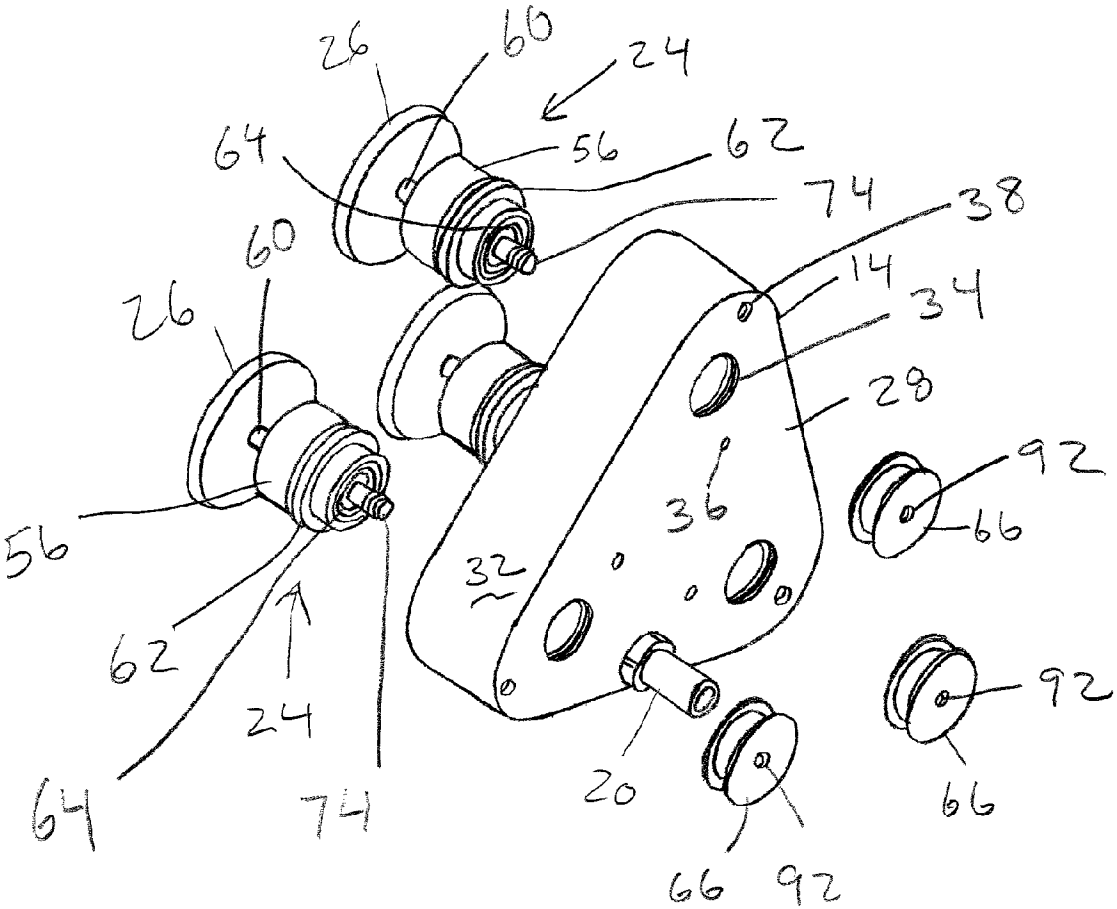
FIG. 5 is a perspective view of a base of a handheld material conditioner according to the present invention.
Figure 6:
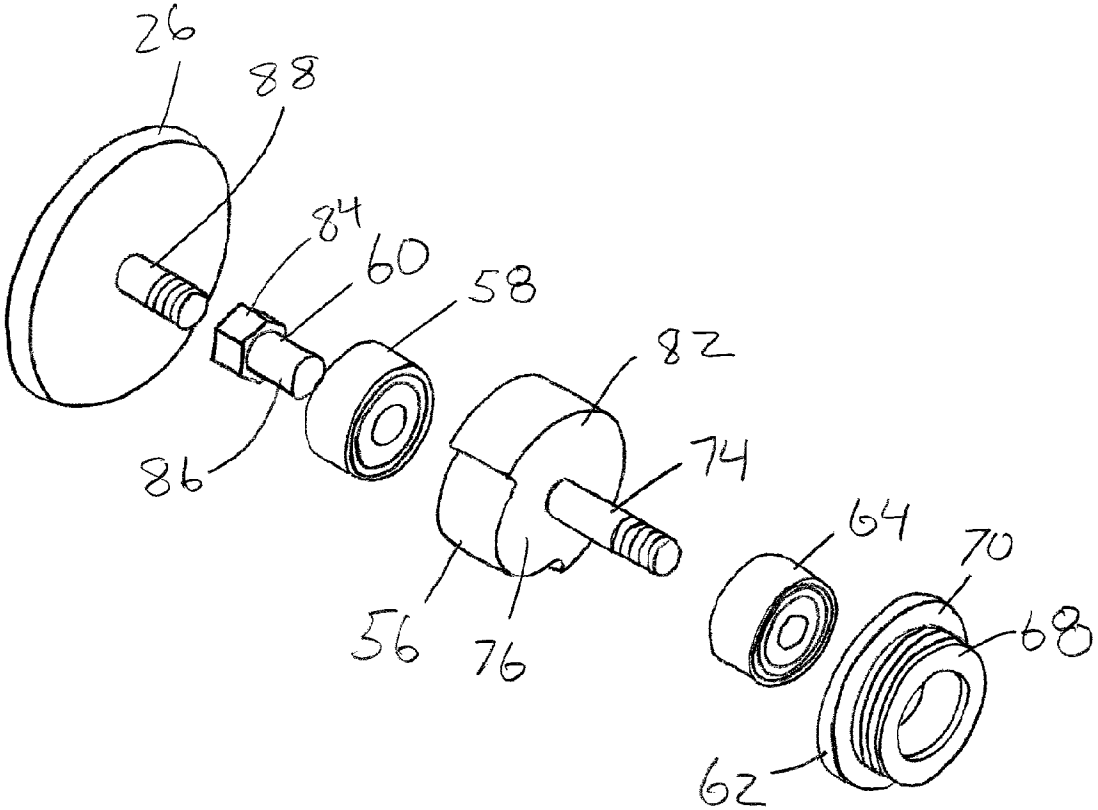
FIG. 6 is an exploded view of an orbital head assembly according to the present invention.
Figure 7:
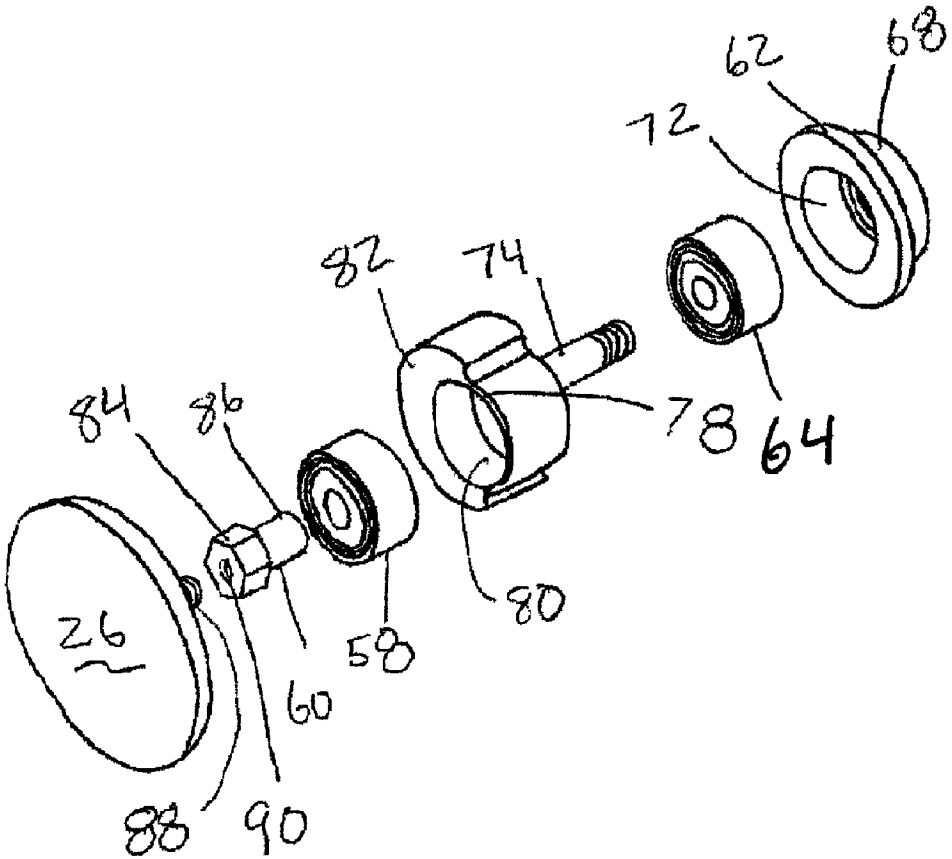
FIG. 7 is an exploded view of an orbital head assembly according to the present invention.

The three orbital head assemblies 24 are shown in more detail in FIGS. 5-7. The three orbital head assemblies 24 each include a rotating orbital head 56, orbital head bearing assembly 58, conditioning pad shaft 60, base attachment collar 62, base attachment collar bearing assembly 64 and an orbital pulley 66. The base attachment collar 62 includes a threaded end 68 on the top 70 of the base attachment collar 62. FIG. 7 shows a bearing cavity 72 within the base attachment collar 62. The orbital head bearing assembly 58 and the base attachment collar bearing assembly 64 are shown as sealed bearings. The base attachment collar bearing assembly 64 is press fitted into the bearing cavity 72 of the base attachment collar 62. The orbital head 56 includes a threaded pulley shaft 74 extending from the top 76 of the orbital head 56. As shown in FIG. 7, the bottom 78 of the orbital head 56 includes a bearing cavity 80 in the orbital head 56. The bearing cavity 80 of the orbital head 56 is offset from the center of the orbital head 56. The orbital head 56 is shaped such that there is additional material to form an enhanced weight section 82 away from the bearing cavity 80, as shown in FIGS. 6-7. The orbital head bearing assembly 58 is press fitted into the bearing cavity 80 of the orbital head 56. The conditioning pad shaft 60 includes a pad end 84 and a bearing end 86. The bearing end 86 of the conditioning pad shaft 60 is press fitted into the orbital head bearing assembly 58 that is fitted into the orbital head 56. The threaded pulley shaft 74 is inserted into and thru the base attachment collar bearing assembly 64 that is fitted into the base attachment collar 62, such that threads of the threaded pulley shaft 74 extend beyond the base attachment collar bearing assembly 64. The conditioning pad 26 includes a threaded stud 88. The pad end 84 of the conditioning pad shaft 60 includes a threaded cavity 90 to allow attachment of the conditioning pad 26 by threading the threaded stud 88 of the conditioning pad 26 into the threaded cavity 90 of the pad end 84 of the conditioning pad shaft 60.

Figure 8:
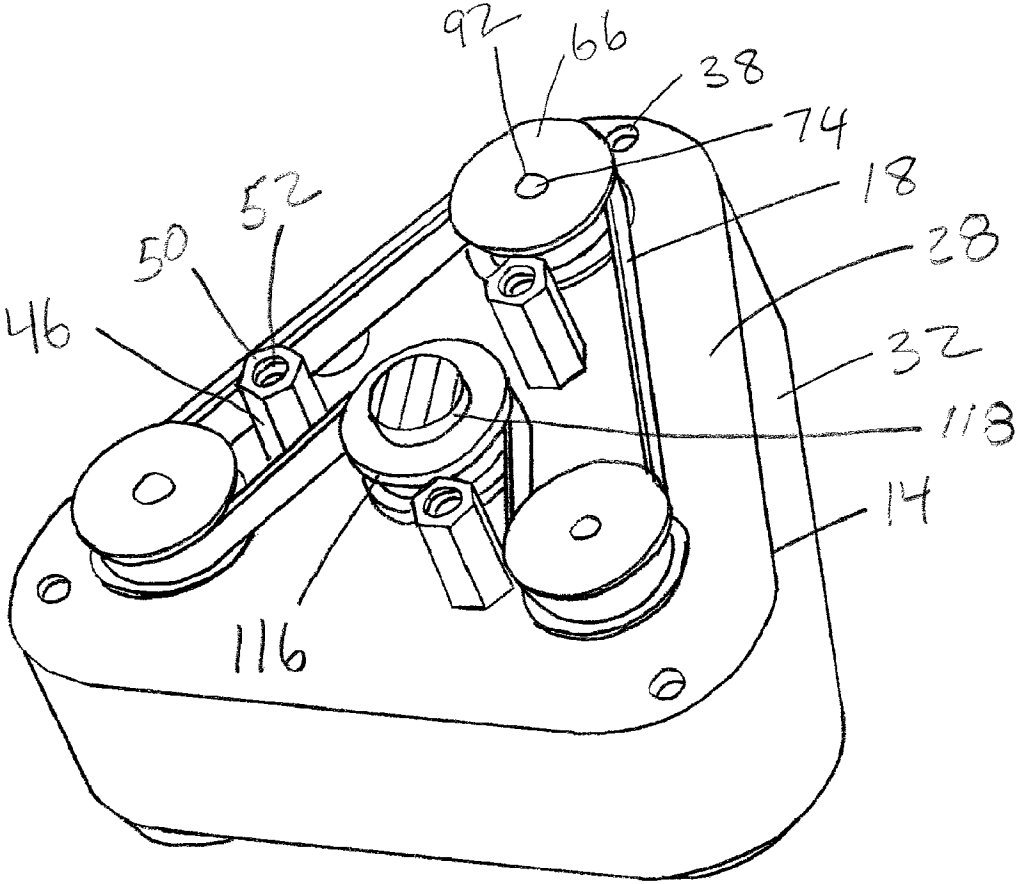
FIG. 8 is a perspective view of a base of a handheld material conditioner according to the present invention.
Figure 9:
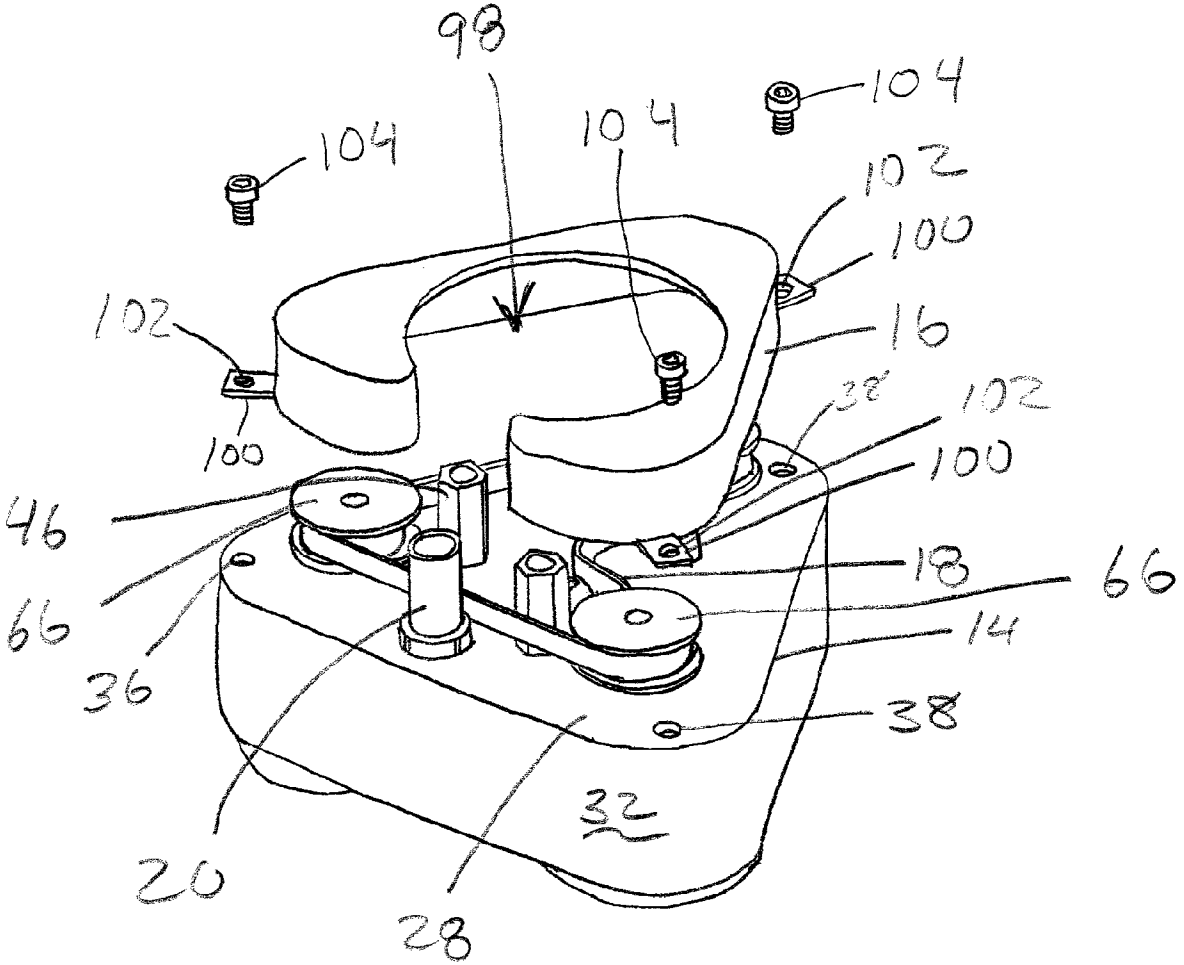
FIG. 9 is a perspective view of a base of a handheld material conditioner according to the present invention.
Figure 10:
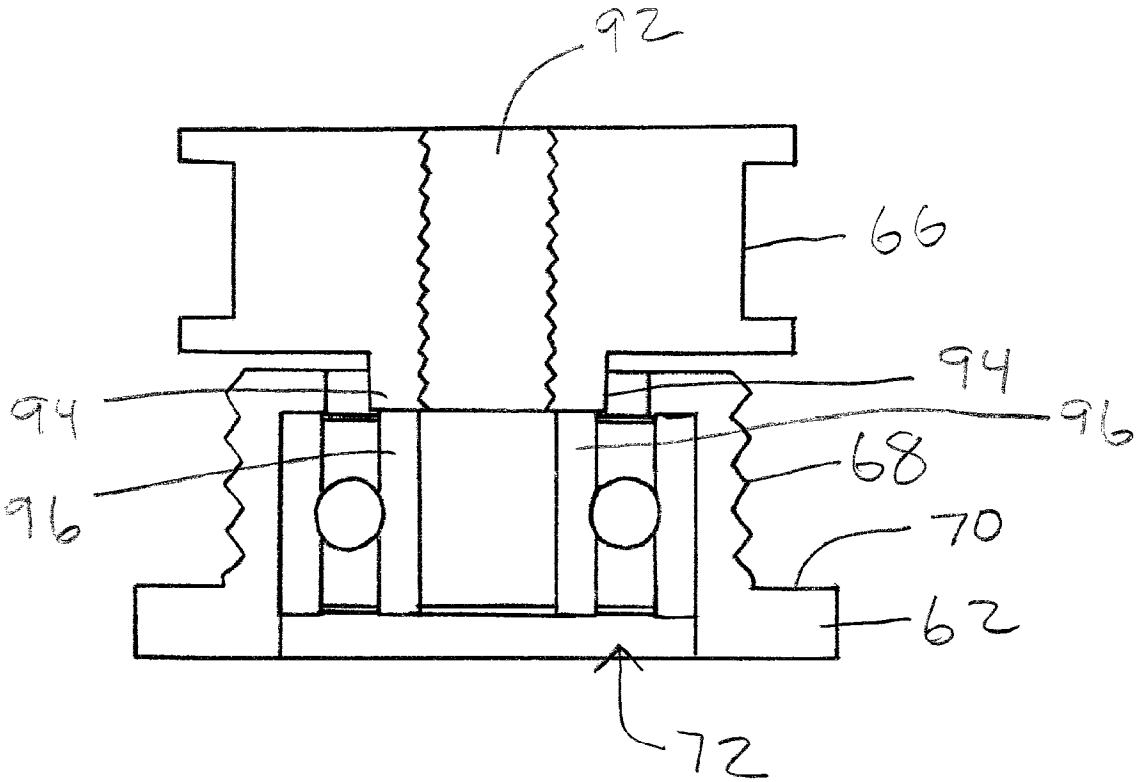
FIG. 10 is a cut-away view of an orbital pulley, base attachment collar, and base attachment collar bearing assembly of a handheld material conditioner according to the present invention.

The threaded end 68 of the base attachment collar 62 of each of the orbital head assemblies 24 threads into one of the orbital head assembly holes 34 from the bottom 30 of the base 14. The base attachment collar 62 is threaded into the orbital head assembly hole 34 until the base attachment collar 62 is tightened against the bottom 30 of the base 14. The orbital pulley 66 includes a threaded hole 92 which threads onto the threads of the threaded pulley shaft 74. The orbital pulley 66 includes a contact ring 94, which faces the base attachment collar bearing assembly 64 in the base attachment collar 62, as shown in FIG. 10. The orbital pulley 66 is tightened against an inside race 96 of the base attachment collar bearing assembly 64, which locks the inside race 96 and contact ring 94 together. The tightening of the orbital pulley 66 against the inside race 96 holds the orbital head 56 in place in an upward position within the orbital head assembly 24 and to the base 14. The belt 18 attaches around the three orbital pulleys 66, as shown in FIG. 8. The belt cover 16 includes a motor opening 98 to receive the motor assembly 22. The belt cover 16 includes mounting tabs 100 with bolt holes 102. Bolts 104 are inserted into the bolt holes 102 of the mounting tabs 100 and are threaded into the belt cover holes 38 of the base 14 to secure the belt cover 16 to the base 14.

Figure 11:
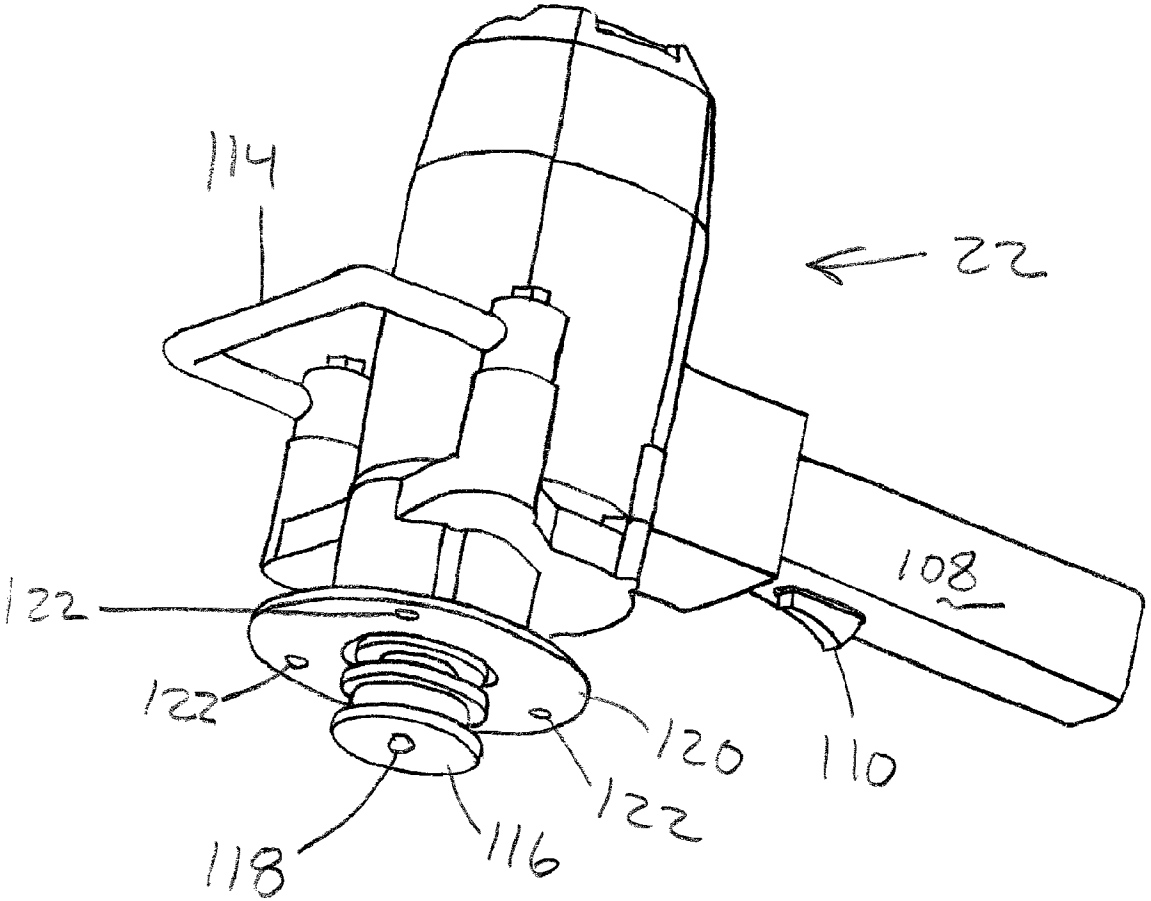
FIG. 11 is a perspective view of a motor housing of a handheld material conditioner according to the present invention.

The motor assembly 22 includes a housing 106 with a motor (not shown) mounted within the housing 106. The motor assembly 22 includes a first handle 108 in the shape of a pistol grip with a trigger 110. The trigger 110 is an on/off device connected to the motor and is used to activate the motor. A power cord 112 extends out from the first handle 108 and provides power to the trigger 110, and hence power to the motor. A second handle 114 is mounted to the housing 106 to allow a two hand grip for added control the handheld material conditioner 10. The motor assembly 22 includes a motor pulley 116 attached to a shaft 118 of the motor, as shown in FIGS. 8 and 11. When the motor assembly 22 is fitted to the base 14, the motor pulley 116 is inserted into the motor opening 98 of the belt cover 16 and pushes against the belt 18, as shown in FIG. 8. The motor assembly 22 includes a motor collar 120 attached to the housing 106. The motor collar 120 includes bolt holes 122 which align with the threaded openings 52 of the motor end 50 of the motor spacers 46. Motor bolts 124 are inserted into the bolt holes 122 of the motor collar 120 and threaded into the openings 52 of the motor end 50 of the motor spacers 46 to secure the motor assembly 22 to the base 14. The motor spacers 46 provide the proper positioning and clearance to allow for the motor pulley 116 to align with the belt 18 and orbital pulleys 66, without contacting the base 14.

When power is applied by pulling the trigger 110, the motor rotates the motor pulley 116. Rotation of the motor pulley 116 turns the belt 18 and rotates each of the orbital pulleys 66 of the orbital head assemblies 24. Rotation of the orbital pulleys 66 of the orbital head assemblies 24 causes the threaded pulley shafts 74 to rotate, and hence the orbital heads 56 to rotate. The attachment of the conditioning pad shafts 60 in an offset position from the center of the orbital heads 56 and the ability of the conditioning pad shafts 60 to rotate independently of the orbital heads 56 causes the conditioning pads 26 to rotate in a random orbital pattern. The rotation of the conditioning pads 26 in a random orbital pattern makes the handheld material conditioner 10 easier to control by the user and produces an improved conditioning action. Since the handheld material conditioner 10 is easier to control, the user is less likely to make a mistake during material conditioning.

While different embodiments of the invention has been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention which is to be given the full breadth of any and all equivalents thereof.

I claim:

1. A handheld material conditioner to condition a material comprising:

at least three orbital head assemblies which provide a random rotating orbital action onto said material during conditioning of the material;

a motor, said motor connected to said at least three orbital head assemblies to rotate said at least three orbital head assemblies;

a housing to house said motor, said housing having at least one handle and having an on/off device to send power to said motor;

a base to which said at least three orbital head assemblies are attached said base having a top, bottom and at least one side extending down from said base to act as shielding;

a conditioning pad attached to each of said at least three orbital head assemblies for conditioning the material said conditioning pad attached such that each of said conditioning pads is rotated by each of said at least three orbital head assemblies;

wherein each of said at least three orbital head assemblies comprises:

a base attachment collar mounted to said base, said including a bearing cavity;

a base attachment collar bearing fitted into said bearing cavity of said base attachment collar;

a rotating orbital head, said orbital head including a threaded pulley shaft extending from a top of said orbital head, said threaded pulley shaft fitted into said base attachment collar bearing and extending beyond said base attachment collar bearing to allow for attachment to said motor, said orbital head including a bearing cavity in a bottom of said orbital head, said bearing cavity being offset from a center of said orbital head, said orbital head having an enhanced weight section away from said bearing cavity;

a orbital head bearing fitted into said bearing cavity in said bottom of said orbital head;

a conditioning pad shaft that includes a pad end and a bearing end, said bearing end rotatably fix to said orbital head bearing, said pad end attached to said conditioning pad; and wherein said base includes a orbital head assembly hole for each of said at least three orbital head assemblies; wherein said base attachment collar includes a threaded end on a top of said base attachment collar; and wherein said threaded end screws into said orbital head assembly hole to secure each of said at least three orbital head assemblies to said base.

2. The handheld material conditioner according to claim 1, further including an orbital head pulley attached to each of said threaded pulley shafts above said top of said base; further including a motor pulley attached to said motor; and further including a belt interconnecting said orbital head pulleys and said motor pulley, such that said motor pulley drives said orbital head pulleys with said belt.

3. The handheld material conditioner according to claim 2, further including motor spacers mounted between said housing and said base to allow proper positioning and clearances for said motor pulley.

4. The handheld material conditioner according to claim 2, further including a second handle mounted to said housing.

5. The handheld material conditioner according to claim 2, wherein said orbital head pulley includes a contact ring which locks against said base attachment collar bearing to hold said orbital head in place.

6. The handheld material conditioner according to claim 1, further including a second handle mounted to said housing.

7. The handheld material conditioner according to claim 1, further including a dust tube mounted into said base to collect dust and having an end adapted to connect to a vacuum.

* * * * *